US009992574B2

(12) United States Patent
Esses

(10) Patent No.: US 9,992,574 B2
(45) Date of Patent: Jun. 5, 2018

(54) MULTI-COMPARTMENT TRAVELING KIT FOR AUDIO-VISUAL SYSTEMS

(71) Applicant: Que Products, LLC, Jamaica, NY (US)

(72) Inventor: Seymour Esses, Jamaica, NY (US)

(73) Assignee: Que Products, LLC, Jamaica, NY (US)

( * ) Notice: Subject to any disclaimer, the term of this patent is extended or adjusted under 35 U.S.C. 154(b) by 427 days.

(21) Appl. No.: 14/303,469

(22) Filed: Jun. 12, 2014

(65) Prior Publication Data

US 2015/0365763 A1 Dec. 17, 2015

(51) Int. Cl.
*H04R 1/02* (2006.01)
*H04R 3/12* (2006.01)

(52) U.S. Cl.
CPC ..... *H04R 3/12* (2013.01); *H04R 1/028* (2013.01); *A45F 2200/0516* (2013.01); *A45F 2200/0525* (2013.01); *H04R 2201/023* (2013.01); *H04R 2420/07* (2013.01)

(58) Field of Classification Search
CPC ..... H04R 2201/023; A45F 2200/0508; A45F 2200/0516; A45F 2200/0525
See application file for complete search history.

(56) References Cited

U.S. PATENT DOCUMENTS 7,821,751 B2 * 10/2010 Mejyr ..... G06F 1/182 361/111
2005/0230445 A1 10/2005 Woo
2007/0045369 A1 3/2007 Chen
2010/0188212 A1 7/2010 Jochelson
2012/0262117 A1 * 10/2012 Ferber ..... H02J 7/0047 320/111
2013/0156251 A1 6/2013 Noble

FOREIGN PATENT DOCUMENTS

CN 201323987 Y * 10/2009

OTHER PUBLICATIONS https://web.archive.org/web/20130523010402/http://reviews.mtbr.com/osprey-packs-fall-2013-commuter-pack-preview, archived May 23, 2013.*

(Continued)

*Primary Examiner* — Duc Nguyen
*Assistant Examiner* — Kile Blair
(74) *Attorney, Agent, or Firm* — Moritt Hock & Hamroff LLP; Steven S. Rubin, Esq.

(57) ABSTRACT

Methods and products for activating a backpack audio-visual system are generally described. In an example, a module in the backpack may detect a presence of a device in a first compartment that may be defined by a first set of walls. In response to the detection, the module may determine a status of a first speaker and a second speaker. The first and second speakers may be inside of a second compartment and a third compartment, respectively. The second and third compartments may be defined by a second and a third set of walls, respectively. Based on the presence of the device in the first compartment and the status of the first and second speakers, the module may establish a wireless communication link between the device and the first and second speakers. The backpack audio-visual system may be activated in response to the establishment of the wireless communication link.

11 Claims, 3 Drawing Sheets

(56) References Cited

OTHER PUBLICATIONS

SK Soundkase SoundSak Sonic "i" Boom Audio Backpack. Manual [online]. Scosche, 2005 [retrieved on Aug. 2005]. Retrieved from http://images.crutchfieldonline.com/Manuals/142/142SKIBBG. PDF, 9 pages.

eBags Powerbag by ful 6000 mAH Deluxe Laptop Backpack. Catalog [online]. eBags, 2011 [retrieved on Feb. 9, 2013]. Retrieved from http://www.ebags.com/product/powerbag-by-ful/6000-mah-deluxe-laptop-backpack/226437, 8 pages.

International Search Report and Written Opinion for PCT application with application No. PCT/US15/11595, dated Apr. 10, 2015, 33 pages.

* cited by examiner

MULTI-COMPARTMENT TRAVELING KIT FOR AUDIO-VISUAL SYSTEMS

BACKGROUND

Unless otherwise indicated herein, the materials described in this section are not prior art to the claims in this application and are not admitted to be prior art by inclusion in this section.

A portable device may provide a convenient way for a user to enjoy audio or visual entertainment such as music, movies, games, etc. Protection for the portable device may be desirable when the user desired to travel with the portable device from a first location to a second location. The user may desire to use the portable device while the portable device is being protected.

SUMMARY

In some examples, products associated with an audio-visual system are generally described. A product may include at least a first surface, a second surface, and a third surface. The first, second, and third surfaces may be contiguous to each other and may be effective to define a volume of the product. The product may further include a first set of walls that may be effective to define a first compartment. The first set of walls may be attached to the first surface. The product may further include a second set of walls that may be effective to define a second compartment. The second set of walls may be attached to the second surface. The product may further include a third set of walls that may be effective to define a third compartment. The third set of walls may be attached to the third surface. The first compartment may include a first speaker that may be configured to receive audio data from the audio-visual system wirelessly. The second compartment may include a second speaker that may be configured to receive the audio data from the audio-visual system wirelessly. The third compartment may include a fourth set of walls that may be effective to define a pocket. The pocket may be effective to receive a device. The pocket may include a window and may be effective to allow light to travel between the pocket and outside of the product. The third compartment may further include a module. The module may include a battery. The module may further include a control unit that may be configured to control operations of the audio-visual system. The module may further include an indicator unit that may be effective to indicate a status associated with the audio-visual system. The audio-visual system may include the device, the module, the first speaker, and/or the second speaker.

In some examples, backpack audio-visual systems are generally described. A backpack audio-visual system may include a first speaker that may be configured to receive audio data wirelessly. The first speaker may be inside of a first compartment. The first compartment may be defined by a first set of walls. The backpack audio-visual system may further include a second speaker that may be configured to receive the audio data wirelessly. The second speaker may be inside of a second compartment. The second compartment is defined by a second set of walls. The backpack audio-visual system may further include a device that may be configured to output the audio data to the first and second speakers wirelessly. The backpack audio-visual system may include a module inside of a third set of a third compartment. The third compartment may be defined by a third set of walls. The module may include battery, an indicator unit, and/or a control unit. The battery may be configured to provide power to the backpack audio-visual system. The indicator unit may be configured to indicate a battery level of the battery. The indicator unit may be further configured to a status of the first and second speakers. The control unit may be configured to establish a communication link between the device and the first and second speakers when the device is inside of the pocket. The backpack audio-visual system may be activated in response to the establishment of the communication link.

In some examples, methods for activating a backpack audio-visual system are generally described. The methods may include detecting a presence of a device in a first compartment of a backpack. The first compartment may be defined by a first set of walls. The methods may further include, in response to the detection of the presence of the device in the first compartment, determining a status of a set of speakers. The set of speakers may include a first speaker and a second speaker. The first speaker may be inside of a second compartment of the backpack. The second speaker may be inside of a third compartment of the backpack. The second compartment may be defined by a second set of walls. The third compartment may be defined by a third set of walls. The methods may further include, based on the detection of the presence of the device and based on the determination of the status of the first and second speakers, establishing a wireless communication link between the device and the first and second speakers. The backpack audio-visual system may be activated in response to the establishment of the wireless communication link.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
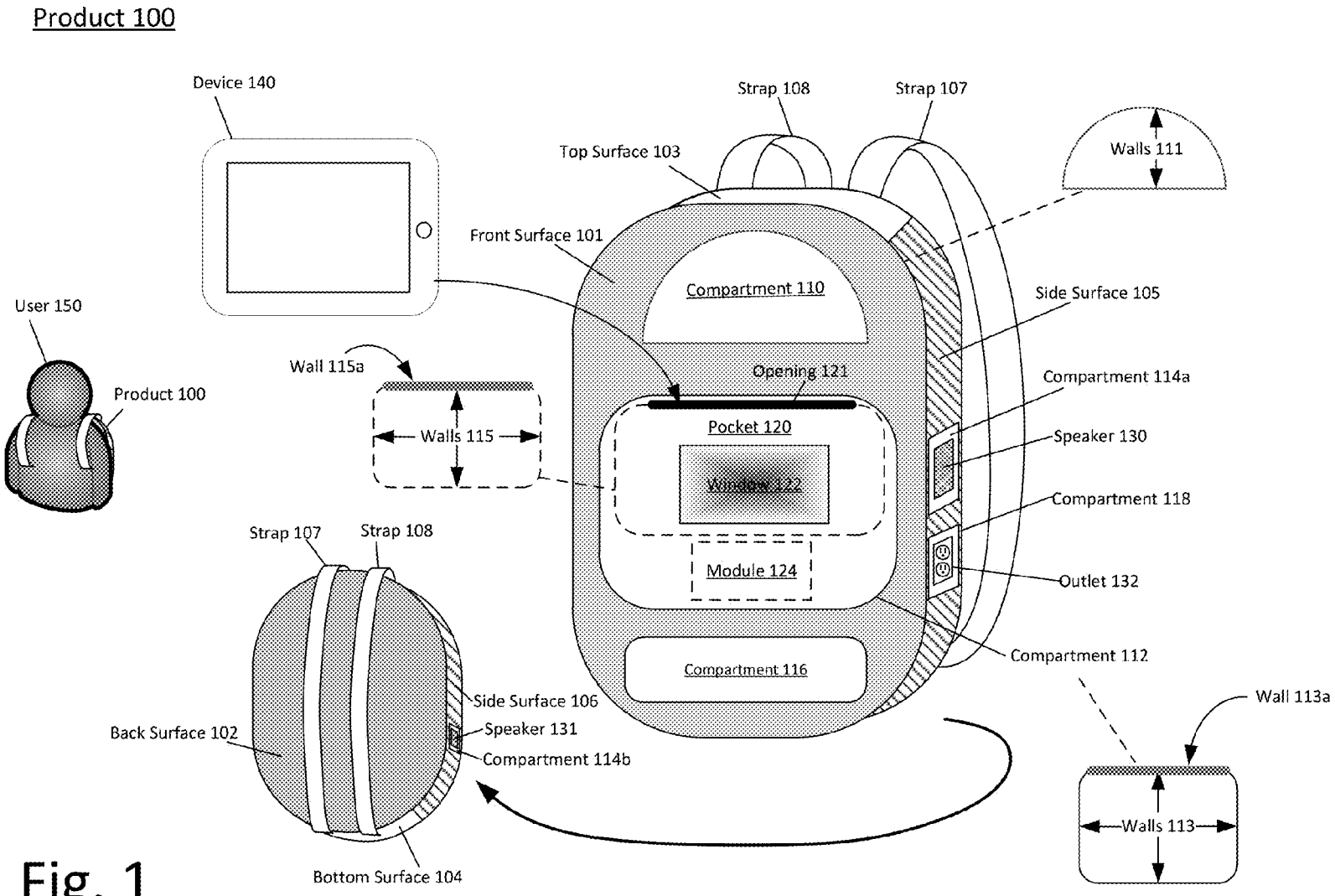
FIG. 1 illustrates a front and back perspective view of a product associated with a multi-compartment traveling kit for audio-visual systems.

all arranged according to at least some embodiments described herein.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

FIG. 1 illustrates a front and back perspective view of a product 100 associated with a multi-compartment traveling kit for audio-visual systems, arranged in accordance with at least some embodiments described herein. Product 100 may be a traveling kit for an audio-visual system and may be a bag such as a backpack, suitcase, purse, etc. Product 100 may include a front surface 101, a back surface 102, a top surface 103, a bottom surface 104, a side surface 105, and/or a side surface 106. Front surface 101, back surface 102, top surface 103, bottom surface 104, side surface 105, and/or side surface 106 may be effective to define a volume of product 100. Product 100 may further include at least a strap, such as strap 107 and/or strap 108 effective to connect top surface 103 and bottom surface 104 such as by being attached to top surface 103 and/or bottom surface 104. A user such as user 150 may use product 100 such as by wearing product 100 with use of strap 107 and/or strap 108.

Product 100 may include one or more compartments such as a compartment 110, a compartment 112, a compartment 114*a*, a compartment 114*b*, a compartment 116, and/or a compartment 118. Each compartment may be defined by a set of walls. For example, a set of walls 111 may be effective to define compartment 110. Similarly, a set of walls 113 may be effective to define compartment 112. In some examples, at least a wall within a set of walls may be attached to a surface of product 100. For example, a wall among set of walls 113 may be attached to front surface 101 of product 100 in order to attach compartment 112 to product 100. At least a portion of compartments 110, 112, 114*a*, 114*b*, 116, 118 may extend beyond the surfaces of product 100, or may be indented in the volume of product 100.

Each compartment among compartments 110, 112, 114*a*, 114*b*, 116, 118 may include respective components. For example, compartment 114*a* may include a speaker 130, compartment 114*b* may include a speaker 131, and compartment 118 may include an outlet 132. Components of a compartment may or may not be exposed on a surface of product 100. For example, at least a portion of speaker 130 and at least a portion of outlet 132 may be exposed, such as visible to user 150, on side surface 105 of product 100. Similarly, at least a portion of speaker 131 may be exposed, such as visible to user 150, on side surface 106 of product 100. In some examples, a set of walls which define each compartment among compartments 110, 112, 114*a*, 114*b*, 116, 118 may be of the same or different materials. In some examples, a particular compartment among compartments 110, 112, 114*a*, 114*b*, 116, 118 may be an empty compartment configured to receive objects and/or components from outside of product 100. In some examples, an empty compartment may receive a component to modify a function of product 100.

Compartment 112 may include a set of walls 115 which may be effective to define a pocket 120. A wall 113*a* in set of walls 113 and a wall 115*a* in set of walls 115 may be attached to each other. Compartments 110, 112, 114*a*, 114*b*, 116, 118 may or may not include openings. For example, compartment 112 may include an opening 121, which may be sealed such as by use of a zipper, effective to provide access into an interior of pocket 120. Opening 121 may be positioned on at least a wall of pocket 120 such as wall 115*a* of set of walls 115. Opening 121 may also be part of wall 113*a* when wall 113*a* is attached to wall 115*a* as shown. Pocket 120 may be effective to receive an object, such as a device 140, through opening 121. Device 140 may be a computing device such as a tablet computer. Device 140 may be a playback device configured to output audio and/or visual data. Pocket 120 may include a window 122, where window 122 may be effective to allow light to travel between pocket 120 and outside of product 100. In some examples, in response to pocket 120 receiving device 140, device 140 may be visible through window 122. In some examples where device 140 may include a touchscreen display, user 150 may use device 140, such as by providing touch commands, through window 122 when device 140 is inside of pocket 120. Compartment 112 may further include a module 124, which may be outside of pocket 120. As will be described in more detail below, module 124 may include components configured to facilitate operations of an audio-visual system comprising device 140, module 124, speaker 130, and/or speaker 131.

Figure 2:
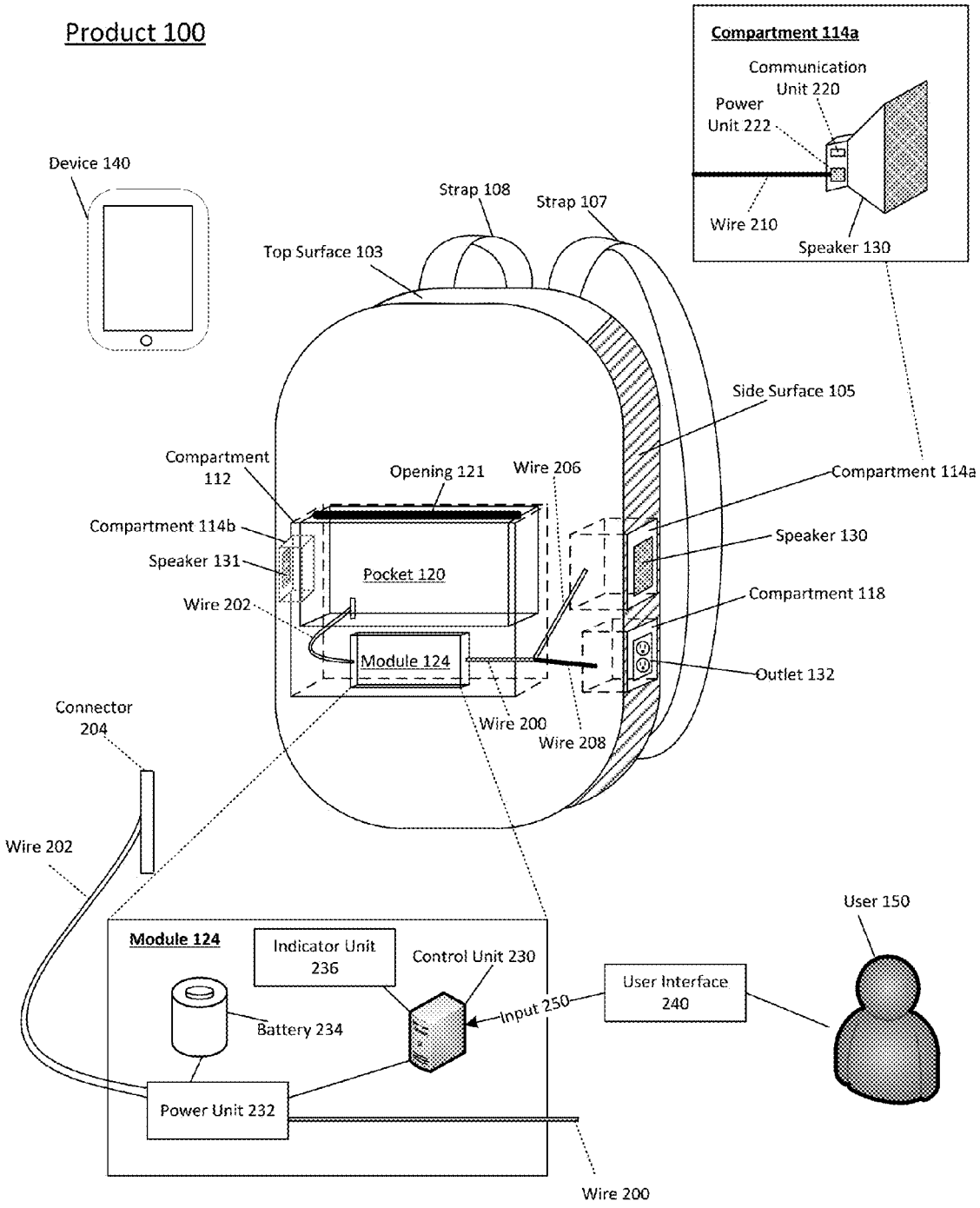
FIG. 2 illustrates a front perspective cut-away view of the product associated with a multi-compartment traveling kit for audio-visual systems.

FIG. 2 illustrates a front perspective cut-away view of product 100 associated with a multi-compartment traveling kit for audio-visual systems, arranged in accordance with at least some embodiments described herein. FIG. 2 includes elements in FIG. 1, with additional details. Those elements in FIG. 2 that are labeled identically to elements of FIG. 1 will not be described again for the purposes of clarity.

Compartment 112 may include at least a wire such as a wire 200 and a wire 202. Wire 200 may be configured to facilitate transmission of power to module 124 and from module 124. Wire 202 may be configured to facilitate transmission of power from module 124 to a connector 204. Connector 204 may be a power connector attached to an end of wire 202. Connector 204 may further be configured to provide power to device 140 when connector 204 is connected to device 140. Product 100 may further include a wire 206 and a wire 208. Wire 206 may be a wire configured to facilitate transmission of power from wire 200 to compartment 114*a*. Wire 206 may be connected to a wire 210 inside of compartment 114*a*. Wire 210 may be configured to facilitate transmission of power from wire 206 to speaker 130. Wire 208 may be a wire configured to facilitate transmission of power from compartment 118 to wire 200. Product 100 may further include additional wires effective to facilitate transmission of power from module 124 to other components and/or compartments of product 100, such as speaker 131 in compartment 114*b*.

Focusing on compartment 114*a*, speaker 130 in compartment 114*a* may include a communication unit 220 and a power unit 222. Power unit 222 may be a component of speaker 130 which may be configured to receive power transmitted from module 124 through wires 200, 206, 210. An activation of speaker 130 may be based on power received at power unit 222. Communication unit 220 may be a BLUETOOTH module, which may be activated by power received at power unit 222. Communication unit 220 may be configured to receive audio data from a device, such as device 140, wirelessly. Compartment 114*b* may include similar components as compartment 114*a*. Speaker 131 may include similar components as speaker 130. In some examples, in response to activation of communication unit 220, a discoverable mode of speaker 130 may be activated in order for speaker 130 to be discovered by other devices such as device 140.

Focusing on module 124 in compartment 112, module 124 may include a control unit 230, a power unit 232, a battery 234, and/or an indicator unit 236. Battery 234 may be a rechargeable battery. Power unit 232 may be configured to facilitate charging of battery 234 such as by receiving power from compartment 118 through wires 208, 200 and providing the received power to battery 234. Power unit 232 may be further configured to transmit power to compartment 114 through wires 200, 206, 210. When device 140 is connected to connector 204, power unit 232 may transmit power to device 140 through wire 202.

Control unit 230 may be configured to control operations of power unit 232 and/or indicator unit 236. In an example, power unit 232 may be configured to monitor a battery level of battery 234. Control unit 230 may be configured to detect the battery level of battery 234 from power unit 232 and in response, control indicator unit 236 to output an indication of the battery level of battery 234. Control unit 230 may be further configured to monitor power output by power unit 232 to wire 200 and based on the monitoring, control unit 230 may determine whether speaker 130 is activated. Control unit 230 may control indicator unit 236 to output an indication of an activation status of speaker 130. Indication output by indicator unit 236 may be light emitted from at least one LED (light emitting diode) positioned on a surface of product 100.

In some examples, user 150 may provide an input 250 to control unit 230 using a user interface 240 configured to be in communication with control unit 230. In some examples, module 124 may further include a receiver and user interface 240 may be a controller configured to transmit signals to the receiver of module 124. In some examples, user interface 240 may be located on a surface of product 100 and may include one or more buttons. In an example, input 250 may be a request to check a status of speaker 130. User 150 may provide input 250 to control unit 230 using user interface 240. Control unit 230 may receive input 250 and in response, may determine the status of speaker 230. Control unit 230 may control indicator unit 236 to output the status of speaker 130 to fulfill the request (input 250) by user 150. In another example, input 250 may be a request to activate or deactivate speaker 130. In another example, input 250 may be a request for the battery level of battery 234.

Figure 3:
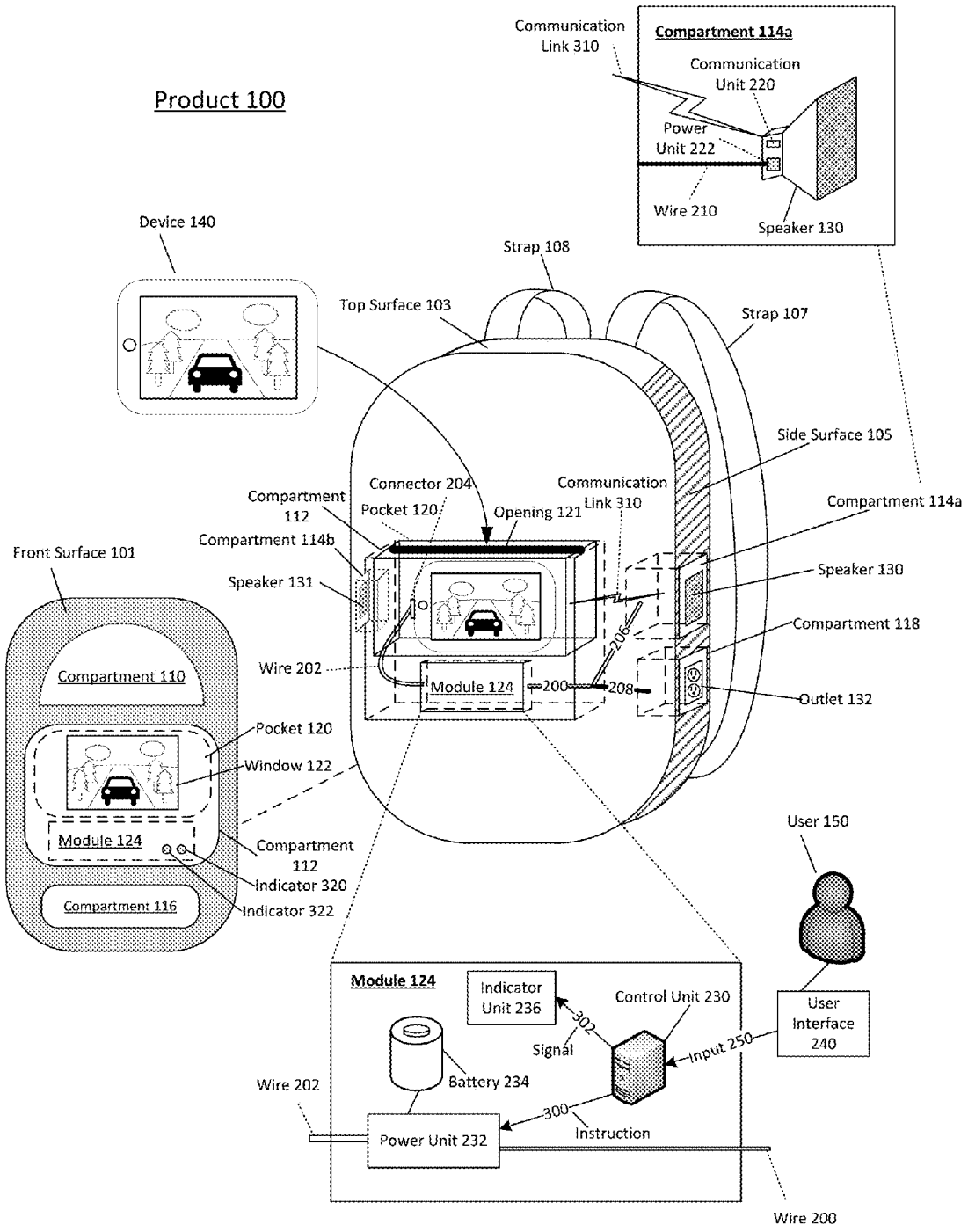
FIG. 3 illustrates a front perspective cut-away view of the product associated with a multi-compartment traveling kit for audio-visual systems.

FIG. 3 illustrates an example implementation of product 100 associated with multi-compartment traveling kit for audio-visual systems, arranged in accordance with at least some embodiments described herein. FIG. 3 includes elements in FIG. 1, with additional details. Those elements in FIG. 3 that are labeled identically to elements of FIG. 1 will not be described again for the purposes of clarity.

In an example, pocket 120 may receive device 140, such as by user 150 inserting device 140 into pocket 120 through opening 121. User 150 may connect device 140 with module 124 such as by connecting connector 204 with an interface on device 140. In response to the connection of connector 104 with device 140, module 124 may provide power to device 140 through wire 202 and connector 104. In some examples, wire 202 may be a bus such as a universal serial bus (USB) configured to facilitate transmission of data and/or signals between module 124 and device 140.

In the example, when device 140 is inside of pocket 120, user 150 may view device 140 through window 122 of pocket 120. Control unit 230 may detect whether device 140 is inside of pocket 120 such as by determining whether power is being output by power unit 232 to wire 202. In response to a presence of device 140 in pocket 120, control unit 230 may determine a status of a communication unit, such as a BLUETOOTH module, of device 140. If the communication unit of 140 is activated, control unit 230 may further determine a status of speaker 130. Control unit 230 may determine whether power is being output by power unit 232 to wire 200. Control unit 230 may send an instruction 300 to power unit 232 to activate speaker 130 if a status of speaker 130 shows that speaker 130 is deactivated. When speaker 130 is activated, communication unit 220 may be activated and speaker 130 may be in a discoverable mode. When both the communication unit of device 140 and communication unit 220 of speaker 130 are activated, a communication link 310 may be established. When both the communication unit of device 140 and communication unit 220 of speaker 130 are BLUETOOTH modules, communication link 310 may be a wireless communication link based on the BLUETOOTH communication protocol. In response to the establishment of communication link 310, an audio-visual system comprising device 140, module 124, speaker 130, and/or speaker 131 may be activated. In some examples, product 100 may use BLUETOOTH communication to communicate with a nearby phone. With use of the BLUETOOTH communication, a user may be able to handle a telephone call such as through a microphone and speaker 130. A user may be able to use user interface 240 to skip music tracks such as utilizing fast forward and rewind features.

In an example, in response to the determination of status communication unit 220 of speaker 130, control unit 230 may send a signal 302 to indictor unit 236. Signal 302 may be signal effective to indicate the status communication unit 220 of speaker 130. Indicator unit 236 may be configured to be in communication with at least an indicator 320 and an indicator 322 on a surface of product 100, such as front surface 101, or a surface of a compartment such as compartment 112. Indicators 320, 322 may be light emitting diodes (LEDs). In an example, control unit 230 may send signal 302 to indicator unit 236 to indicate that communication unit 220 of speaker 130 is activated. In response to receipt of signal 302, indicator unit 236 may instruct an indicator among indicators 320, 322 to show the status indicated by signal 302 such as by issuing a binary signal to the indicator.

In some examples, product 100 may further include more than one LED on at least a surface of product 100. User 150 may instruct module 124, such as by providing input 250 to module 124, to activate the LEDs in order to enhance visibility on product 100 in a situation with low visibility such as night time.

In some examples, compartment 110 and/or compartment 116 may include materials effective to add and/or modify functionality of product 100. For example, compartment 116 may include insulated materials effective to regulate temperature within compartment 116. User 150 may insert temperature sensitive objects, such as food or medication, in compartment 116 to avoid disintegration of the temperature sensitive objects.

Among other possible benefits, the product in accordance with the disclosure may benefit a user by providing a computing device traveling kit product which includes numerous functions. The user may use the product to charge a computing device while the user is traveling. The user may use the product to listen to music by the computing device through wireless speakers of the product. The wireless speakers of the product may provide a convenient method to connect the computing device with the speakers when the user desires to listen to music or hear audio of a movie when the device is inside of the traveling kit product.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A product associated with an audio-visual system, the product comprising:

at least a first surface, a second surface, and a third surface, wherein the first, second, and third surfaces are contiguous to each other and, are effective to define a volume of the product;

a first set of walls effective to define a first compartment, wherein the first set of walls are attached to the first surface;

a second set of walls effective to define a second compartment, wherein the second set of walls are attached to the second surface;

a third set of walls effective to define a third compartment, wherein the third set of walls are attached to the third surface;

the first compartment comprises a first speaker configured to receive audio data from the audio-visual system wirelessly;

the second compartment comprises a second speaker configured to receive the audio data from the audio-visual system wirelessly;

the third compartment comprises:

a fourth set of walls effective to define a pocket, wherein the pocket is effective to receive a tablet computer device configured to display video and to output audio data, the pocket comprises a window, and the window is effective to allow light to travel between the pocket and outside of the product, and allow video, displayed on the tablet computer device, to be viewed;

a module comprising a battery, a control unit configured to control operations of the audio-visual system, and an indicator unit effective to indicate a status associated with the audio-visual system, wherein the control unit is configured to:

detect a presence of the tablet computer device by a determination that power is being output to the tablet computer device;

detect a battery level of the battery;

provide a first indication of the battery level to the indicator unit;

detect a status of the first and second speakers; and provide a second indication of the status to the indicator unit;

the indicator unit is configured to be in communication with a first indicator and a second indicator, the first indicator is effective to output an indication associated with the battery level of the battery, and the second indicator is effective to output an indication associated with the status of the first and second speakers; and a universal serial bus (USB) wire within the third compartment, wherein the USB wire connects the module to the tablet computer and facilitates transmission of power and data between the module and the tablet computer device when the tablet computer device is inside of the pocket;

a fifth set of walls effective to define a fourth compartment, wherein the fourth compartment comprises a three-prong power outlet exposed on at least one of the first, second, or third surfaces, and the power outlet is effective to facilitate charging the battery of the module; and wherein the audio-visual system comprises the tablet computer device, the module, the first speaker, and the second speaker.

2. The product of claim 1, wherein the third set of walls and the fourth set of walls are effective to define an opening, wherein the opening is effective to facilitate receipt of the tablet computer device by the pocket.

3. The product of claim 1, wherein the module is configured to utilize BLUETOOTH communication with a nearby phone and handle a telephone call from the nearby phone.

4. The product of claim 1, wherein the control unit is configured to activate the first and second speakers.

5. The product of claim 1, further comprising a sixth set of walls effective to define a fifth compartment, wherein the sixth set of walls are associated with insulated materials effective to regulate a temperature of an interior of the fifth compartment.

6. A backpack audio-visual system, the backpack audio-visual system comprising:

a first speaker configured to receive audio data wirelessly, wherein the first speaker is inside of a first compartment, and the first compartment is defined by a first set of walls;

a second speaker configured to receive the audio data wirelessly, wherein the second speaker is inside of a second compartment, and the second compartment is defined by a second set of walls;

a tablet computer device configured to display video and to output the audio data to the first and second speakers wirelessly inside of a pocket defined by a third set of walls, wherein the pocket is effective to receive the tablet computer device, the pocket comprises a window, and the window is effective to allow light to travel between the pocket and outside of the pocket, and allow video, displayed on the tablet computer device, to be viewed;

a module inside of a third compartment defined by a fourth set of walls, the module comprising a battery, an indicator unit, and a control unit, wherein:

the battery is configured to provide power to the backpack audio-visual system;

the indicator unit is configured to indicate a battery level of the battery on a first indicator and the indicator unit is configured to indicate a status of the first and second speakers on a second indicator; and the control unit is configured to establish a communication link between the tablet computer device and the first and second speakers when the tablet computer device is inside of the pocket, wherein the backpack audio-visual system is activated in response to the establishment of the communication link, the control unit is further configured to:

detect a presence of the tablet computer device by a determination that power is being output to the tablet computer device;

detect a battery level of the battery;

provide a first indication of the battery level to the indicator unit;

detect a status of the first and second speakers; and provide a second indication of the status to the indicator unit;

wherein the third compartment includes a universal serial bus (USB) wire effective to facilitate transmission of power and data between the module and the tablet computer device when the tablet computer device is inside of the pocket; and a fifth set of walls effective to define a fourth compartment, the fourth compartment comprises a three-prong power outlet exposed on at least one of the first, second, or third surfaces, and the power outlet is effective to facilitate charging the battery of the module of the audio-visual system.

7. The backpack audio-visual system of claim 6, wherein the module is configured to utilize BLUETOOTH communication with a nearby phone and handle a telephone call from the nearby phone.

8. The backpack audio-visual system of claim 6, wherein the wireless communication link is based on the BLUETOOTH communication protocol.

9. A method for activating a backpack audio-visual system, the method comprises, by a module:

detecting a presence of a tablet computer device by determining power is being output to the tablet computer device, wherein the tablet computer device is configured to display video and to output audio data in a first compartment of a backpack, wherein the first compartment is defined by a first set of walls, wherein the first compartment includes a pocket, wherein the pocket is effective to receive the tablet computer device, and the pocket comprises a window a window effective to allow light to travel between the pocket and outside of the pocket, and allow video, displayed on the tablet computer device, to be viewed;

in response to the detection of the presence of the tablet computer device in the first compartment, detecting a battery level of a battery and determining a status of a set of speakers comprising a first speaker and a second speaker, wherein the first speaker is inside of a second compartment of the backpack and the second speaker is inside of a third compartment of the backpack, the second compartment is defined by a second set of walls, and the third compartment is defined by a third set of walls;

providing a first indication of the battery level to an indicator unit;

providing a second indication of the status of the first and second speakers to the indicator unit, wherein the indicator unit is in communication with a first indicator and a second indicator;

based on the detection of the presence of the tablet computer device and based on the determination of the status of the first and second speakers, establishing a wireless communication link between the tablet computer device and the first and second speakers; and wherein the backpack audio-visual system is activated in response to the establishment of the wireless communication link and the first indicator outputs an indication associated with the battery level of the battery, and the second indicator outputs an indication associated with the status of the first and second speakers.

10. The method of claim 9, wherein the wireless communication link is based on the BLUETOOTH communication protocol.

11. The method of claim 9, wherein the establishment of the wireless communication link comprises activating the first and second speakers, and wherein the wireless communication link is established in response to the first and second speakers being activated.

* * * * *